US011441208B2

(12) United States Patent
Hasselqvist

(10) Patent No.: US 11,441,208 B2
(45) Date of Patent: Sep. 13, 2022

(54) NICKEL BASED ALLOY

(71) Applicant: Siemens Energy Global GmbH & Co. KG, Bayern (DE)

(72) Inventor: Magnus Hasselqvist, Finspong (SE)

(73) Assignee: Siemens Energy Global GmbH & Co. KG, Bayern (DE)

( * ) Notice: Subject to any disclaimer, the term of this patent is extended or adjusted under 35 U.S.C. 154(b) by 0 days.

(21) Appl. No.: 17/281,389

(22) PCT Filed: Sep. 5, 2019

(86) PCT No.: PCT/EP2019/073672
§ 371 (c)(1),
(2) Date: Mar. 30, 2021

(87) PCT Pub. No.: WO2020/074187
PCT Pub. Date: Apr. 16, 2020

(65) Prior Publication Data

US 2022/0033936 A1 Feb. 3, 2022

(30) Foreign Application Priority Data

Oct. 10, 2018 (EP) ..... 18199591

(51) Int. Cl.
*C22C 19/05* (2006.01)
*C22F 1/10* (2006.01)

(52) U.S. Cl.
CPC ..... *C22C 19/056* (2013.01); *C22F 1/10* (2013.01)

(58) Field of Classification Search
CPC ..... C22C 19/056; C22F 1/10
See application file for complete search history.

(56) References Cited

U.S. PATENT DOCUMENTS 3,619,182 A 11/1971 Bieber
4,597,809 A 7/1986 Duhl et al.
6,419,763 B1 7/2002 Konter et al.
6,818,077 B2 * 11/2004 Yoshinari ..... C22C 19/056 420/451
2004/0221925 A1 11/2004 Tamaki et al.
2014/0348689 A1 11/2014 Hardy et al.
2015/0147226 A1 5/2015 Yoshinari et al.

FOREIGN PATENT DOCUMENTS

CN 105149597 A 12/2015
EP 1054072 A1 11/2000
EP 2805784 A1 11/2014

OTHER PUBLICATIONS

PCT International Search Report and Written Opinion of International Searching Authority dated Oct. 24, 2019 corresponding to PCT International Application No. PCT/EP2019/073672 filed Sep. 5, 2019.
Chen, Jiafu et al: "Fluorine compounds-industrial solvents"; Chemical Encyclopedia; vol. 5; Chemical Industry Press; 1993.
Chen, Guoliang: "Superalloys"; Metallurgical Industry Press; 1988.
Second Central Laboratory of Shanghai Fifth Steel Plant: "High-temperature alloy"; Shanghai Institute of Science and Technology Information; 1977.
English-language version of the search report from corresponding Chinese Patent Application for Invention No. 201980066793.8.
Metallographic Analysis Writing Group of Shanghai Jiaotong University: "Metallographic Analysis"; National Defense Industry Press; p. 477; published in Apr. 1982.

* cited by examiner

*Primary Examiner* — Jessee R Roe
(74) *Attorney, Agent, or Firm* — Wolter Van Dyke Davis, PLLC

(57) ABSTRACT

A nickel based superalloy, including: Chromium (Cr) 12.0%-14.0%, Molybdenum (Mo) 1.5%-3.0%, Tungsten (W) 2.5%-4.5%, Aluminum (Al) 4.0%-5.0%, Titanium (Ti) 1.8%-2.8%, Niobium (Nb) 1.5%-3.5%, Hafnium (Hf) 0.8%-1.8%, Carbon (C) 0.03%-0.13%, Boron (B) 0.005%-0.025%, Silicon (Si) 0.005%-0.05%, and optionally: Cobalt (Co) 0.0%-10.0%, Tantalum (Ta) 0.0%-3.0%, Zirconium (Zr) 0.0%-0.03%, especially remainder Nickel.

19 Claims, No Drawings

NICKEL BASED ALLOY

CROSS REFERENCE TO RELATED APPLICATIONS

This application is the US National Stage of International Application No. PCT/EP2019/073672 filed 5 Sep. 2019, and claims the benefit thereof. The International Application claims the benefit of European Application No. EP18199591 filed 10 Oct. 2018. All of the applications are incorporated by reference herein in their entirety.

FIELD OF INVENTION

The innovation relates to a nickel based alloy.

BACKGROUND OF INVENTION

The aim for increasing combined cycle efficiency leads to increase of the hot gas temperatures in the larger downstream blades. But at the same time the cooling air usage should be kept low. Furthermore one wants to increase the length of the last blade to reduce the outlet Mach number. Hence creep becomes limiting. The designers are furthermore restricted by LCF at the blade attachment and in the disc, i.e. there is a limit to the extent to which they can solve the creep problem by making the lower part of the airfoil thicker, and this limitation becomes more restricting with increasing alloy density. The problem is particularly difficult for single-shaft gas turbines.

The alloys IN792 and CM247CC and CM247DS are known alloys. CC alloys are however preferable in the last stage because of the higher complexity of DS casting and the fact that the casting challenge increases with component size. CM247CC gives lower creep rates than IN792, but enters tertiary creep at lower creep levels and has a higher density. CM247CC and CM247DS have good castability, IN792 is nearly as good, whereas GTD-444 is likely to be difficult to cast. IN792 has a higher corrosion resistance than GTD-444 and CM247CC, hence GTD-444 and CM247CC will need corrosion coatings under conditions where IN792 does not, and the use of corrosion coatings, which are notoriously brittle, in long slender HCF prone blades should be avoided if possible.

EP 1 054 072 A1 discloses high values of Cobalt (Co) and Tungsten (W) and low values of Aluminum (Al) and no Niobium (Nb).

US 2004/0221925 A1 discloses low values of Molybdenum (Mo), low values of Chromium (Cr) or the presence of Rhenium (Re).

There is requirement a 30K density corrected advantage in creep strength over IN792.

SUMMARY OF INVENTION

The problem is solved by an alloy according to the independent claim.

The idea is to have a new alloy which can be named as 'IN792' with +30K in 'creep strength'. By this we mean that the creep strength, taking density into account, should be 30K better than for IN792 in the 973K to 1223K range while the processability like casting and heat treatment, all other mechanical properties, the corrosion resistance and the oxidation resistance should be similar or better compared to IN792.

Molybdenum (Mo) and Tungsten (W) participate to the strength of the γ matrix, wherein Aluminum (Al), Titanium (Ti), Tantalum (Ta), Niobium (Nb) and Hafnium (Hf) form γ' particles and wherein Titanium (Ti), Tantalum (Ta), Niobium (Nb) and that Hafnium (Hf) strengthen these γ' particles. Tungsten (W) and Tantalum (Ta) are bad actors in the sense that they increase the density.

IN792 is similar to CM247CC in density corrected creep capability despite significantly less 'Mo+W' for strengthening of the γ matrix' and a significantly lower γ' particle content, but thanks to more 'Ti+Ta+Hf' for strengthening of the γ' particles and a lower density.

Therefore we prepare a Nickel based alloy, comprising, especially consisting of (in wt %):

Chromium (Cr) 12.0%-14.0%,
especially 12.0%-13.0%,
Molybdenum (Mo) 1.5%-3.0%,
especially 1.6%-2.2%,
Tungsten (W) 2.5%-4.5%,
especially 3.6%-4.0%,
Aluminum (Al) 4.0%-5.0%,
especially 4.3%-4.7%,
Titanium (Ti) 1.8%-2.8%,
especially 2.0%-2.6%,
Niobium (Nb) 1.5%-3.5%,
especially 2.0%-3.4%,
Hafnium (Hf) 0.8%-1.8%,
especially 0.8%-1.4%,
Carbon (C) 0.03%-0.13%,
especially 0.07% Carbon (C),
Boron (B) 0.005%-0.025%,
especially 0.01% Boron (B),
Silicon (Si) 0.005%-0.05%,
especially 0.01% Silicon (Si),
and optionally
Cobalt (Co) 0.0%-10.0%,
especially 4.0%-6.0%,
Tantalum (Ta) 0.0%-3.0%,
especially 0.5%-3.0%,
very especially 2.0%-2.4% Tantalum (Ta),
Zirconium (Zr) 0.0%-0.03%,
especially 0,001%-0.03% Zirconium (Zr),
especially
no Rhenium (Re) and/or no Ruthenium (Ru) and/or no Yttrium (Y),
remainder Nickel.

DETAILED DESCRIPTION OF INVENTION

Following best modes are listed here below (in wt %).

| Alloy A | |
|---|---|
| Cr | 12.5 |
| Co | 5.0 |
| Mo | 1.8 |
| W | 3.8 |
| Al | 4.5 |
| Ti | 2.2 |
| Ta | 2.2 |
| Nb | 2.2 |
| Hf | 1.0 |
| C | 0.07 |
| B | 0.01 |
| Zr | 0.01 |
| Si | 0.01 |

| Alloy B | |
|---|---|
| Cr | 12.5 |
| Co | 5.0 |
| Mo | 1.8 |
| W | 3.8 |
| Al | 4.5 |
| Ti | 2.4 |
| Nb | 3.2 |
| Hf | 1.2 |
| C | 0.07 |
| B | 0.01 |
| Zr | 0.01 |
| Si | 0.01, |
| | especially no Tantalum (Ta). |

The levels of the matrix strengthening in these alloys elements Molybdenum (Mo) and Tungsten (W) are on at least the IN792 level. In terms of particle strengthening, Tantalum (Ta) has been partly or completely replaced by Niobium (Nb) and Hafnium (Hf), and in addition Aluminum (Al) has been reduced to enable inclusion of Titanium (Ti), resulting in a significantly increased strength. Niobium (Nb) and Hafnium (Hf) provide strengthening per at % on about the same level as Tantalum (Ta), but because of the difference in density between Tantalum (Ta), Niobium (Nb) and Hafnium (Hf), we only need about 1 wt % Niobium (Nb) to replace 2 wt % Ta and 1 wt % Hafnium (Hf) to replace 1.5 wt % Tantalum (Ta). Hence 8 wt % Tantalum (Ta) can be especially replaced by 3.2 wt % Niobium (Nb) and 1.1 wt % Hafnium (Hf). We have further limited Titanium (Ti) to levels at which enable a high HTW resulting in good homogenization and no residual eutectics, as this is regarded as important for good mechanical properties.

The alloys have at least a 15K in advantage in absolute creep strength and we should also get 10K to 15K in advantage thanks to a reduced density relative to IN792. Hence we get an overall density corrected advantage of about 30K in density corrected creep capability relative to IN792.

The composition is limited by following consideration:

Cobalt (Co) is allowed to vary within rather wide limits although there might be a risk for partial ordering degradation at blade root temperatures at the low end and TCP precipitation at 1023K or so at the higher end, hence the intermediate level of especially 5% in the trial alloys.

It is within the especially 12% to 14% Chromium (Cr) range we are able to find alloys with high creep strength and a reasonable corrosion resistance. Below 12% Chromium (Cr) the corrosion resistance falls fast because the ability to form a protective $Cr_2O_3$ layer is lost, and above 14% Chromium (Cr) the creep strength falls fast because we will be forced to reduce levels of particles and/or strengthening elements. Going below 12% Chromium (Cr) is also a case of diminishing returns in terms of creep strength, because even if less Chromium (Cr) allows for more strengthening elements in terms of 'equilibrium calculation TCP resistance', the HTW will fall and this will cause more residual segregation which is detrimental to the mechanical properties, and more strengthening elements also means a higher density.

Molybdenum (Mo) is advantageous to Tungsten (W) in terms of density, but too much Molybdenum (Mo) will reduce the hot corrosion resistance. The trial alloys above have especially 1.8% Molybdenum (Mo) just as IN738LC and IN792, and going higher might be detrimental, but let's allow ourselves 3% in the application and see if this could at best be used.

Since 3% Molybdenum (Mo) is not sufficient, we will have to utilize Tungsten (W) even if it increases the density. It is however kept at reasonably moderate levels.

If we want almost 60 mol % of strong particles according to the Titanium (Ti)+Tantalum (Ta)+Niobium (Nb)+Hafnium (Hf) recipe outlined above, this is simply where we end up in terms of Aluminum (Al) content. It is lower than in truly oxidation resistant alloys such as CM247CC with their ability to form protective $Al_2O_3$ layers, but it is nevertheless higher than in most classical industrial gas turbine alloys like Rene80 (3 wt % Al), IN738LC (3.4 wt % Al) and IN792 (3.4 wt % Al) which should provide an advantage over them.

The balance between Titanium (Ti), Tantalum (Ta), Niobium (Nb) and Hafnium (Hf) in terms of 'strengthening with a low density' was outlined above, as was the need to limit Titanium (Ti) to enable a high HTW. In addition, a high Hafnium (Hf) level is usually regarded as good for castability, especially by providing hot tearing resistance. Furthermore, while the main idea is that this should be a new CC alloy, the high Hafnium (Hf) content promotes DS castability.

The combination of Carbon (C), Boron (B) and Zirconium (Zr) is chosen to provide good grain boundary strengthening while not resulting on hot tearing, and the hot tearing issue is why Zirconium (Zr) is at a low level. Low Zirconium (Zr) also helps with DS castability.

Silicon (Si) is usually not included in specification for high creep strength superalloys, because it tends to reduce the grain boundary strength, at least when used at 0.05% and above. It is however almost present as a 'contaminant' at levels in the order of 0.01% or so when master heats are done. There are papers indicating that if the master heat producers managed to actually reduce it even lower, to 'almost zero', then this could seriously impair the oxidation and corrosion resistance, because Silicon (Si) is apparently a catalyst in the formation of a protective $Cr_2O_3$ layer within the oxide scale. So it's a safety measure to include it but at a small controlled level.

The balance between Titanium (Ti), Tantalum (Ta), Niobium (Nb) and Hafnium (Hf) to get high strength and low density while maintaining a good HTW despite a high particle content.

The invention claimed is:

1. A Nickel based alloy, comprising (in wt %):
Chromium (Cr) 12.0%-14.0%,
Molybdenum (Mo) 1.5%-3.0%,
Tungsten (W) 2.5%-4.5%,
Aluminum (Al) 4.0%-5.0%,
Titanium (Ti) 1.8%-2.8%,
Niobium (Nb) 1.5%-3.5%,
Hafnium (Hf) 0.8%-1.8%,
Carbon (C) 0.03%-0.13%,
Boron (B) 0.005%-0.025%,
Silicon (Si) 0.005%-0.05%,
and optionally:
Cobalt (Co) 0.0%-10.0%,
Tantalum (Ta) 0.0%-3.0%,
Zirconium (Zr) 0.0%-0.03%,
remainder Nickel.

2. The Nickel based alloy according to claim 1, comprising (in wt %):

| | |
|---|---|
| Cr | 12.5% |
| Co | 5.0% |

-continued

| | |
|---|---|
| Mo | 1.8% |
| W | 3.8% |
| Al | 4.5% |
| Ti | 2.2% |
| Ta | 2.2% |
| Nb | 2.2% |
| Hf | 1.0% |
| C | 0.07% |
| B | 0.01% |
| Zr | 0.01% |
| Si | 0.01%. |

3. The Nickel based alloy according to claim 1, comprising (in wt %):

| | |
|---|---|
| Cr | 12.5% |
| Co | 5.0% |
| Mo | 1.8% |
| W | 3.8% |
| Al | 4.5% |
| Ti | 2.4% |
| Nb | 3.2% |
| Hf | 1.2% |
| C | 0.07% |
| B | 0.01% |
| Zr | 0.01% |
| Si | 0.01%. |

4. The Nickel based alloy according to claim 1, comprising 2.0 wt %-2.4 wt % Niobium (Nb).

5. The Nickel based alloy according to claim 1, comprising 3.0 wt %-3.4 wt % Niobium (Nb).

6. The Nickel based alloy according to claim 1, comprising 0.8 wt % 1.2 wt % Hafnium (Hf).

7. The Nickel based alloy according to claim 1, comprising 1.0 wt %-1.4 wt % Hafnium (Hf).

8. The Nickel based alloy according to claim 1, comprising 2.2 wt % Tantalum (Ta).

9. The Nickel based alloy according to claim 1, comprising 0.01 wt % Zirconium (Zr).

10. The Nickel based alloy according to claim 1, comprising no Tantalum (Ta).

11. The Nickel based alloy according to claim 1, comprising 2.2 wt % Titanium (Ti).

12. The Nickel based alloy according to claim 1, comprising 2.4 wt % Titanium (Ti).

13. The Nickel based alloy according to claim 1, comprising 1.8 wt % Molybdenum (Mo).

14. The Nickel based alloy according to claim 1, comprising 3.8 wt % Tungsten (W).

15. The Nickel based alloy according to claim 1, comprising 4.5 wt % Aluminum (Al).

16. The Nickel based alloy according to claim 1, comprising 12.5 wt % Chromium (Cr).

17. The Nickel based alloy according to claim 1, wherein the Nickel based alloy consists of (in wt %) the listed elements.

18. The Nickel based alloy according to claim 2, wherein the Nickel based alloy consists of (in wt %) the listed elements.

19. The Nickel based alloy according to claim 3, wherein the Nickel based alloy consists of (in wt %) the listed elements.

* * * * *